US005088779A

United States Patent [19]

Weiss

[11] Patent Number: 5,088,779

[45] Date of Patent: Feb. 18, 1992

[54] DOOR LATCH RELEASE MECHANISM

[75] Inventor: Frank Weiss, New South Wales, Australia

[73] Assignee: Harcor Security Seals Pty Limited, New South Wales, Australia

[21] Appl. No.: 573,981

[22] Filed: Aug. 27, 1990

[30] Foreign Application Priority Data

Aug. 28, 1989 [AU] Australia ..... PJ5973

[51] Int. Cl.[5] ..... E05B 15/02

[52] U.S. Cl. ..... 292/341.16; 292/201

[58] Field of Search ..... 292/341.16, 201, DIG. 60, 292/244

[56] References Cited

U.S. PATENT DOCUMENTS

| | | | |
|---|---|---|---|
| 347,029 | 8/1886 | Fisher | 292/144 |
| 655,476 | 8/1900 | Carleton | 292/144 |
| 1,167,318 | 1/1916 | Schoenle | 292/201 |
| 1,309,645 | 7/1919 | Lopez | 292/201 |
| 3,543,547 | 12/1970 | Sugiyama | 292/201 |

FOREIGN PATENT DOCUMENTS

| | | | |
|---|---|---|---|
| 206324 | 7/1949 | Australia | 292/341.17 |
| 125977 | 9/1900 | Fed. Rep. of Germany | 292/341.16 |
| 1026193 | 3/1958 | Fed. Rep. of Germany | 292/341.16 |
| 1178110 | 1/1970 | United Kingdom | 292/201 |

*Primary Examiner*—Gary L. Smith
*Assistant Examiner*—Darnell Boucher
*Attorney, Agent, or Firm*—Lackenbach, Siegel, Marzullo & Aronson

[57] ABSTRACT

A door latch release mechanism has a housing adapted for mounting in a door jamb, a striker mounted on a shaft in the housing for pivotal movement between a door lock tongue engagement position and a door lock tongue release position, and a stop mounted in the housing. The stop has a portion capable of contacting the striker so as to latch the striker and prevent pivoting thereof from the door lock tongue engagement position. This portion of the stop is generally semi-circular in cross section. The stop is rotatable on its axis so that rotation of the stop to an effective extent releases the striker.

7 Claims, 2 Drawing Sheets

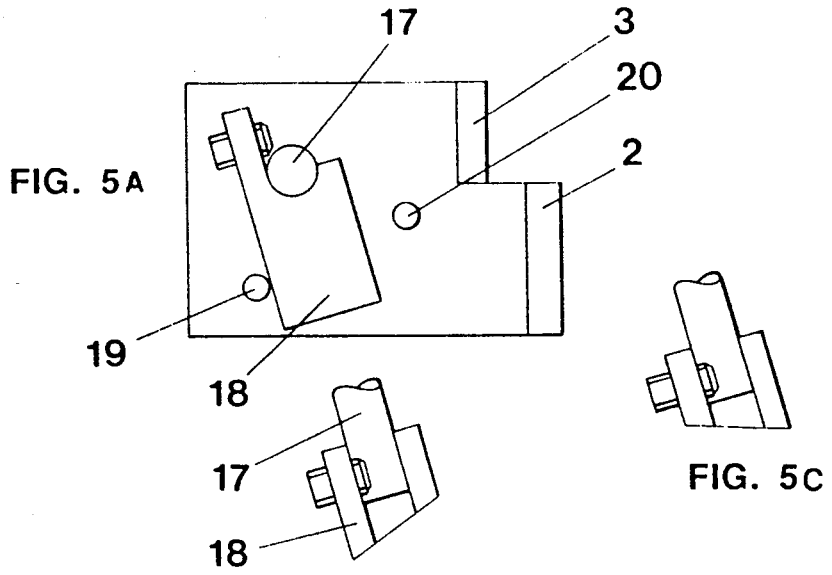
FIG. 5A
FIG. 5B
FIG. 5C
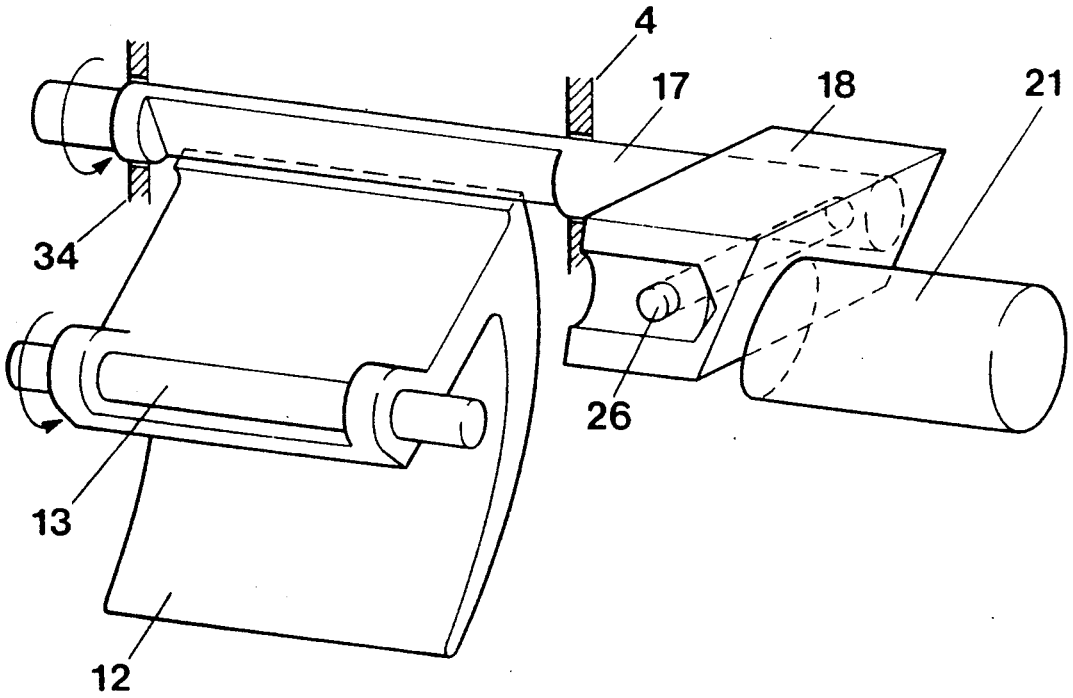
FIG. 6

DOOR LATCH RELEASE MECHANISM

BACKGROUND OF THE INVENTION

1. Field of the Invention

This invention relates generally to door locks. In particular, this invention is concerned with a door latch release mechanism in which a pivotal striker or keeper is latched by a stop and releasable by rotation of the stop. In one embodiment, the invention includes an arrangement whereby the stop may be energised electrically to release the striker or energised electrically to lock the striker by use of a reversible armature or a similar arrangement.

2. Description of the Prior Art

Electrically operated door latch release mechanisms mounted on door frames and the like for locking or unlocking doors from remote locations—such as in security buildings—are known. There are many problems associated with known mechanisms. These include the failure of many prior art mechanisms to operate when a load is applied to the door. For instance, if a wind exerts force against the door or if a person leans against the door, the relationship between the striker and the latch may become distorted, so that deactivation of the latch does not free the striker.

Another problem arises from attempts at forced entry. In some prior art mechanisms, the striker is latched by a relatively small pin or the like and the exertion of force can cause this pin to bend or break, thus releasing the door in an unauthorised situation.

Many prior art mechanisms are difficult to clean or service because they lack ready access to working parts. Many are constructed with insufficient chassis strength. There is a need for a mechanism which can permit access to parts and which has a strong chassis.

In addition to the above, it is desirable to provide a door latch release mechanism which has a dual mode of operation, so that the mechanism can be converted from one which is latched when energised to one which is unlatched when energised. Dual mode operations have been disclosed in U.S. Pat. No. 4,211,44 and PCT Application No. PCT/SE84/00363, published under No. WO 86/02690, for example. However, there is a need for dual mode operations which are simple to convert and which minimise the risk of error on the part of the person effecting the conversion.

SUMMARY OF THE INVENTION

It is an object of this invention to provide a door latch release mechanism which is capable of overcoming or substantially alleviating some or all of the problems referred to above. It is a further object of the invention to provide a door latch release mechanism which may be adapted easily to conversion from the "energised locked" configuration to the "energised unlocked" configuration.

Accordingly, this invention comprises a door latch release mechanism having:

- a housing adapted for mounting in a door jamb;
- a striker mounted on a shaft in the housing for pivotal movement between a door lock tongue engagement position and
- a door lock tongue release position; and
- a stop mounted in the housing and having a portion capable of contacting the striker so as to latch the striker and prevent pivoting thereof from the door lock tongue engagement position, the portion of the stop being generally semi-circular in cross section and the stop being rotatable on its axis so that rotation of the stop to an effective extent releases the striker.

DESCRIPTION OF PREFERRED EMBODIMENTS

Preferably, the stop is rotated by electromagnetic means comprising an armature attached to the stop and a core magnetised by a surrounding coil, the armature and the coil each having an inclined surface capable of attraction to each other in response to the application of electrical energy. In this embodiment, the armature is not affected by gravity and the forces acting on the armature are identical for left hand and right hand doors, which affords the mechanism of the present invention added advantages over the prior art.

In an especially preferred embodiment, the armature is reversibly attached to the stop; reversing of the armature changes the direction of rotation of the stop, thus enabling conversion of the mechanism from a configuration where activation of the armature latches the striker, to a configuration where activation of the armature unlatches the striker. The conversion may be effected within a few seconds and has significant advantages in enabling the reduction of the amount of stock carried by locksmiths.

As illustrated in the Drawings discussed below, the shaft on which the striker is mounted preferably has its axis parallel to the axis of the stop, the striker has an elongated edge parallel to each axis and the portion of the stop is adapted to engage substantially the whole of the elongated edge. This arrangement adds strength to the latching of the striker and reduces wear along the site of engagement, so that the permissible loading of the door is increased.

In addition, the elongated edge of the striker is preferably tangential to the circumference of the stop, so that attempts at forced entry would not achieve release of the door, unless the force applied is so great that the mechanism itself breaks.

The striker should be biassed away from the stop, so that release of the striker causes it to pivot on the shaft. A return spring may be provided for this purpose.

Similarly, the stop should be biassed towards disengagement of the striker. This may be accomplished by a return spring, which must oppose, for example, the magnetic force generated by the coil.

As an alternative, rotary magnets may be located one at each end of the stop. The magnets act in opposing directions and may be operated by a change-over switch. Because the spring opposing the magnetic force of the coil can be omitted in this embodiment, the operating force may be increased. This can enhance reliability and operation under low voltage conditions. In addition, with this configuration it is possible to seal the striker/armature/coil unit and to effect reversal of rotation of the stop by changing the electrical connections to the rotary magnets.

Instead of using a return spring or a pair of rotary magnets as described above, the stop may be motor driven. If geared motors are used, the force on the stop may be increased to such an extent that the door lock will remain operational despite external forces exerted on the door—such as a strong wind or a human body.

The housing is preferably made of a mild steel bar split unevenly on both ends and bent into two hat shaped sections of different depth (or manufactured of two separate bars joined together by welding or brazing), so that a face plate with one inclined face for the depression of dead latch buttons can be attached over the full length of the chassis. This configuration affords a proper bearing surface and gives added strength.

The chassis may be provided with a cover, the removal of which may permit cleaning and servicing as well as access to the armature and/or the coil.

In a situation where it is desired to change the voltage to be applied to the mechanism, the coil which is wholly contained within the chassis and accessible as described, may be replaced in a relatively simple operation, rather than having to discard the whole mechanism.

The coil magnetised core which may be of circular or square cross section with one inclined face can be screwed to one end of the chassis and forms a part of a magnetic path. The armature, preferably of trapezoidal cross section, is fastened to the stop which passes through the flanks of the chassis. Activation of the armature causes a clockwise or anticlockwise rotation of the stop if the coil is energised or de-energised. Once the stop has rotated to a sufficient extent, the edge of the striker is released and the striker pivots to free the door lock tongue.

BRIEF DESCRIPTION OF THE DRAWINGS

The invention will now be described with reference to the Drawings. It is to be understood, however, that the Drawings are for the purposes of illustration only and are not to be interpreted as limiting on the scope of the invention.

In the Drawings:

FIG. 5*a* is a sectional plan view along the lines A—A of FIG. 1 and viewed from below; FIGS. 5*b* and 5*c* show the armature in two configurations; and FIG. 6 details the operation of the striker mechanism.

DETAILED DESCRIPTION

Figure 1:
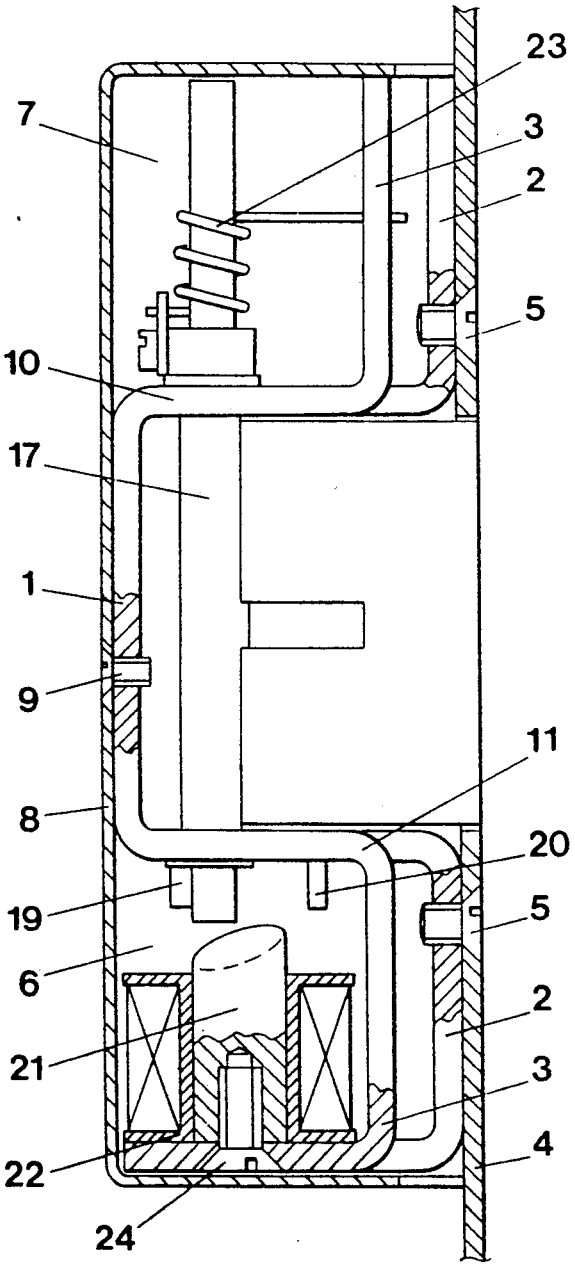
FIG. 1 is a sectional side view of an embodiment of the invention.
Figure 2:
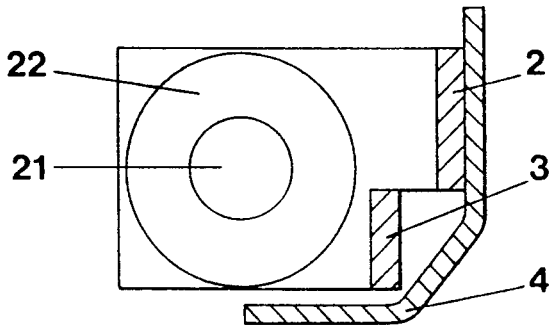
FIG. 2 is a sectional plan view of the core and coil along the lines A—A of FIG. 1 and viewed from above.

Referring first to FIG. 1, a steel bar 1 of rectangular cross-section is split and bent into two hat shaped sections of different depth 2 and 3 so that a chassis is formed to which a face plate 4 can be fastened by screws 5. Face plate 4 has one inclined face (refer FIG. 2) for the operation of dead latch push buttons.

Two compartments 6 and 7 are formed by the chassis and both compartments are easily accessible after removal of cover 8 held by screw 9.

Compartment 6 contains electromagnetic parts for the operation of the latch release. Compartment 7 contains the electrical parts for monitoring the state of the latch release, although these parts have been omitted from the Drawings.

Figure 4:
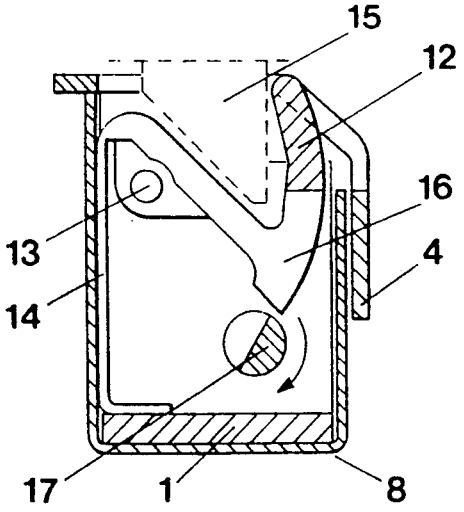
FIG. 4 is a cross section of the latching mechanism viewed from above.

Steel bar 1 includes flanks 10 and 11 which define between them a central compartment containing striker or tongue release 12 (refer FIG. 4) pivotally mounted on shaft 13 and held by spring tension (the spring is not shown) against thrust plate 14 so as to engage tongue 15 of an adjacent door lock. Elongated ground edge 16 of striker 12 is opposed by the solid part of stop 17 (refer FIGS. 1 and 4) and thus is prevented from rotation about shaft 13, unless stop 17 rotates clockwise by approximately 20 degrees to allow edge 16 to pass through the centre of stop 17.

Figure 3:
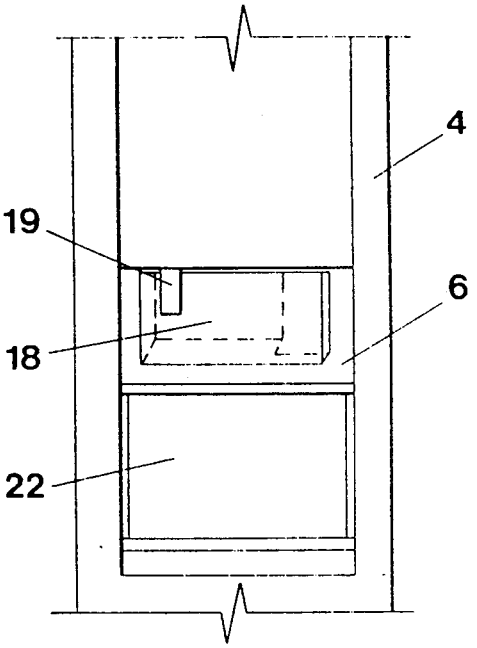
FIG. 3 is an elevation of the lower part of the embodiment in FIG. 1 in direction B, with the cover removed.

Rotation of stop 17 is accomplished by armature 18 (refer FIGS. 3, 5*a* and 5*b*) fastened to stop 17. The movement of armature 18 is limited by projections 19 and 20 (FIGS. 1 and 5*a*). Armature 18 has a trapezoidal cross section opposed by the inclined face of core 21 (FIGS. 1 and 2) so that a diminishing air gap is created between armature 18 and core 21 if coil 22 (FIGS. 1, 2 and 3) is energised. Movement of armature 18 is opposed by torsion spring 23 (FIG. 1).

Referring especially to FIG. 6, striker 12 pivoted around shaft 13 is prevented from rotating in the direction of the arrow shown by stop 17 resting in bearings 34. Stop 17 has a centre portion of semi-circular cross-section. The latched condition of striker 12 thrusting against the door tongue (no shown in this Figure) prevents the opening of the door.

Armature 18 is fastened by pin 26 to stop 17 and is attracted to the inclined surface of core 21 when magnetised by the coil surrounding it (not shown in this Figure), thus rotating stop 17 in the direction of the arrow shown. This rotation in turn releases striker 12 and allows it to pivot about shaft 13.

By withdrawing armature 18 from pin 26 and inserting armature 18 the opposite way, and rotating it by approximately 180 degrees, (refer FIG. 5*c*) the direction of rotation of stop 17 can be changed, thus locking striker 12 if the coil surrounding core 21 is energised. In this configuration, the torque of spring 23 should be reversed by changing the engagement point of one of its ends. In addition, screw 24 (FIG. 1) should be slackened and core 21 should be rotated by 160 degrees (being 180 degrees less the operational movement of 20 degrees).

I claim:

1. A door latch release mechanism having:

a housing adapted for mounting in a door jamb;

a striker mounted on a shaft in the housing for pivotal movement between a door lock tongue engagement position and a door lock tongue release position; and a longitudinally extending stop mounted in the housing and having a portion capable of contacting the striker so as to latch the striker and prevent pivoting thereof from the door lock tongue engagement position, the stop is rotated by electromagnetic means on its longitudinal axis, the shaft having its axis parallel to the axis of the stop and the striker having an elongated edge parallel to each axis, said portion of the stop being generally semi-circular in cross section, wherein said portion of the stop is adapted to engage substantially the whole of the elongated edge in a tangential manner, so that rotation of the stop to an effective extent releases the striker.

2. A door latch release mechanism as claimed in claim 1, wherein the electromagnetic means comprising an armature attached to the stop and a core magnetised by a surrounding coil, the armature and the coil each having an inclined surface capable of attraction to each other in response to the application of electrical energy.

3. A door latch release mechanism as claimed in claim 2, wherein the armature is reversibly attached to the stop and reversing of the armature reverses the direction of rotation of the stop.

4. A door latch release mechanism as claimed in claim 3, which includes means to bias the stop towards the position where the striker is released, the bias means being chosen from the group consisting of:

(a) a return spring mounted on the stop.

5. A door latch release mechanism as claimed in claim 4, wherein the housing is a chassis having a cover the removal of which permits access to the armature and/or the coil.

6. A door latch release mechanism as claimed in claim 5, wherein there is attached to the chassis a face plate having an inclined surface adapted to depress a dead latch button on the door lock.

7. A door latch release mechanism as claimed in claim 6, wherein the chassis is made of mild steel.

* * * * *